United States Patent [19]

Monsees

[11] Patent Number: 4,501,109

[45] Date of Patent: Feb. 26, 1985

[54] PACKAGING MACHINE WITH IMPROVED WEB FEEDING SYSTEM

[75] Inventor: Claude E. Monsees, Durham, N.C.

[73] Assignee: Rexham Corporation, New York, N.Y.

[21] Appl. No.: 374,040

[22] Filed: May 3, 1982

[51] Int. Cl.[3] ..... B65B 9/10; B65B 9/12; B65B 41/16

[52] U.S. Cl. ..... 53/451; 53/551; 53/389; 226/35

[58] Field of Search ..... 53/450, 451, 64, 550, 53/551, 552, 389; 226/34, 35

[56] References Cited

U.S. PATENT DOCUMENTS

| | | | |
|---|---|---|---|
| 2,361,052 | 10/1944 | Patterson | 53/551 X |
| 2,735,677 | 2/1956 | Sandvik et al. | 226/35 |
| 3,294,301 | 12/1966 | Richter | 226/34 X |
| 3,449,888 | 6/1969 | Gausman | 53/552 |
| 3,466,850 | 9/1969 | Hudson et al. | 53/451 |
| 3,789,569 | 2/1974 | Egger | 53/451 |
| 3,921,928 | 11/1975 | Henry | 242/75 |
| 4,009,551 | 3/1977 | Greenawalt et al. | 53/451 |
| 4,144,693 | 3/1979 | Ogata | 53/433 |
| 4,288,965 | 9/1981 | James | 53/451 |
| 4,423,585 | 1/1984 | Monsees et al. | 53/551 X |
| 4,441,664 | 4/1984 | Stohlquist | 226/35 X |

*Primary Examiner*—Horace M. Culver

*Attorney, Agent, or Firm*—Leydig, Voit, Osann, Mayer & Holt, Ltd.

[57] ABSTRACT

A vertical form, fill and seal packaging machine in which a predetermined length of web or film is pulled downwardly past a tube forming collar by endless belts located downstream of the collar. A power-rotated feed roll is located upstream of the collar and pulls film from a supply roll for delivery to the collar, the feed roll being driven at a higher surface speed than the pull down belts. To match the supply of the feed roll with the demand of the belts, means sense the tension in the film at a location between the feed roll and the forming collar and cause the feed roll to slip relative to the film as an inverse function of that tension.

15 Claims, 2 Drawing Figures

PACKAGING MACHINE WITH IMPROVED WEB FEEDING SYSTEM

BACKGROUND OF THE INVENTION

This invention relates generally to a packaging machine and more particularly to a packaging machine of the type which is known as a vertical form, fill and seal machine. In such a machine, a web of packaging material (e.g., a thin film) is drawn from a supply roll and is pulled past a forming collar so as to shape the web into a tube which then is sealed longitudinally. The tube also is sealed transversely at package length intervals and then is cut into individual packages, product being dropped into the tube between successive transverse sealing operations.

In order to form packages of proper length, it is necessary that a precisely predetermined length of the film be drawn past the forming collar during the time interval which occurs between successive transverse sealing operations. To insure against the film being severely stretched or stressed, it is desirable to pull the film past the forming collar with only sufficient tension to maintain the web taut during the forming, filling and sealing operations.

Various machines have been devised for drawing a predetermined length of film from the supply roll for each transverse sealing operation while still maintaining the film under low tension as it is pulled past the forming collar. In virtually all of such machines, a power assist pay off mechanism is located upstream of the forming collar to feed the film from the supply roll to the collar while a separate pull down mechanism is located downstream of the forming collar to pull the film past the collar with low tension. For example, Henry U.S. Pat. No. 3,921,928 discloses a machine in which the supply roll itself is power-rotated to feed the film toward the collar while vertically reciprocable transverse seal bars draw a predetermined length of film past the collar. In the machine disclosed in James U.S. Pat. No. 4,288,965, coacting feed rolls located upstream of the forming collar pull a predetermined length of film from the supply roll and feed that length toward the collar. The film then is pulled past the collar by endless belts which frictionally engage the film.

Other packaging machines with a power assist pay off mechanism upstream of the forming means and with a separate pull down mechanism downstream of the forming means are disclosed in Gausman U.S. Pat. No. 3,449,888; Hudson et al U.S. Pat. No. 3,466,850; Egger U.S. Pat. No. 3,789,569; Greenawalt et al U.S. Pat. No. 4,009,551 and Ogata U.S. Pat. No. 4,144,693.

In machines of the above type, it is necessary to correlate in some manner the action of the upstream power assist mechanism and the action of the downstream pull down mechanism. For example, in the machine disclosed in the James patent, the downstream pull down belts are overdriven with respect to the upstream feed rolls and slip relative to the newly formed tube in order to insure that the belts will pull down all of the film fed out by the rolls without exerting excessive tension on the film. The slippage causes the belts to wear at a comparatively rapid rate and, if a belt breaks or the downstream drive otherwise malfunctions, the upstream feed rolls will continue to deliver film to the forming collar until such time as the entire machine is shut down. In other machines (e.g., the machine disclosed in the Henry patent), a vertically movable dancer roll is located between the power assist mechanism and the forming means to correlate the action of the power assist mechanism with the action of the pull down mechanism. With most machines of this type, the dancer roll causes the power assist mechanism to cycle intermittently and somewhat separately of the pull down mechanism. As a result, the correlation between the two mechanisms is less than optimum and, in addition, it is difficult to maintain good control over the film tension.

SUMMARY OF THE INVENTION

The general aim of the present invention is to provide a packaging machine of the above general type having a new, improved and comparatively simple power assist pay off mechanism which is uniquely correlated with the pull down mechanism in such a manner as to make the machine relatively trouble-free in service use, to enable the components of the pull down mechanism to experience a relatively long service life and to enable comparatively precise tension control to be maintained over the film.

A more detailed object of the invention is to achieve the foregoing by providing a machine in which the length of film needed for each package is determined by the action of the pull down mechanism and in which the power assist pay off mechanism responds automatically to the film tension created by the pull down mechanism and slips at various degrees relative to the film in order to supply the amount of film demanded by the pull down mechanism without creating an oversupply.

Another object of the invention is to provide a machine in which the pull down mechanism and the pay off mechanism are driven in precise synchronism and cycle simultaneously with one another and in which the pay off mechanism is uniquely constructed to slip relative to the film to the extent necessary to match the supply of the pay off mechanism with the demand of the pull down mechanism.

The invention also resides in the provision of unique tension responsive means which control slippage of the pay off mechanism while also enabling selective adjustment of the tension in the film.

These and other objects and advantages of the invention will become more apparent from the following detailed description when taken in conjunction with the accompanying drawings.

DETAILED DESCRIPTION OF THE PREFERRED EMBODIMENT

Figure 1:
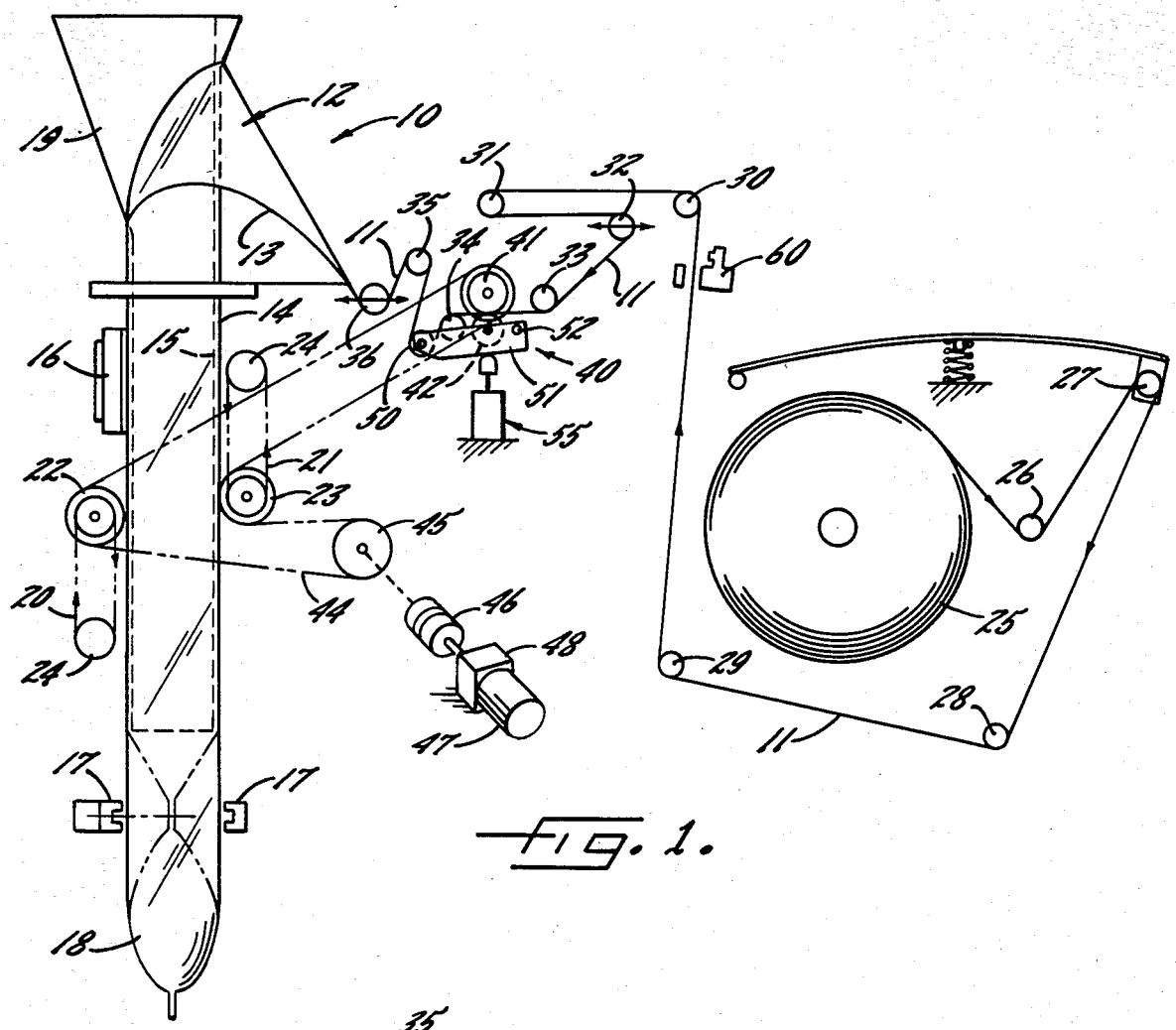
FIG. 1 is a schematic side elevational view of a new and improved packaging machine incorporating the unique features of the present invention.

For purposes of illustration, the invention is shown in the drawings in conjunction with a package making and filling machine 10 which herein is of the vertical form, fill and seal type. Such machines are per se well known and thus the machine will be described only in such detail as is necessary to provide an understanding of the present invention. For a more detailed explanation of the basic construction and operation of a vertical form, fill and seal machine, reference may be made to certain ones of the aforementioned patents and also to Monsees U.S. Pat. No. 3,729,359.

In brief, a web or film 11 of packaging material is delivered to a tube former 12 having a shoulder or collar 13 for forming the film into tubing 14. As the tubing proceeds downwardly along a hollow mandrel 15, its longitudinal side margins are sealed together by a sealing unit 16 to form a longitudinal seal along the tube. At periodic intervals, the tubing is cross-sealed by mechanism indicated generally at 17, each cross-seal ultimately forming the top portion of one package 18 and the bottom portion of the immediately following package. After each cross-sealing operation, product is automatically dropped into the top of the mandrel 15 through a funnel 19 in order to fill the package. Thereafter, the tubing 14 is cut about midway of the height of each cross-seal in order to separate the filled package 18 from the lower end of the tubing.

The film 11 may be advanced over the forming collar 13 and down the mandrel 15 with continuous motion, in which case the sealing, filling and cutting operations are performed on the fly. In this particular instance, however, the film is advanced intermittently and the various operations are performed when the film dwells between successive steps. In either case, a predetermined length of film necessary to form a package 18 of desired length or height is drawn past the forming collar 13 during a given time interval.

Various types of pull down means may be located downstream of the forming collar 13 to pull the film 11 downwardly past the collar and along the mandrel 15. Herein, the particular pull down means which are used are in the form of a pair of endless belts 20 and 21 disposed on opposite sides of the mandrel 15 and frictionally engageable with opposite sides of the tubing 14. The upper end of the belt 20 is located approximately at the same elevation as the lower end of the belt 21. Drive sprockets 22 and 23 are associated with the upper and lower ends of the belts 20 and 21, respectively, while the opposite ends of the belts are trained around idler rollers 24. The drive sprockets are adapted to be rotated intermittently and in a direction to advance the inner runs of the belts downwardly. When so advanced, the belts frictionally grip the tubing 14 to draw the latter downwardly and to pull the film 11 downwardly past the forming collar 13. Vacuum means (not shown) may be associated with the belts to enhance the grip of the belts on the tubing. In lieu of using belts, rotary friction wheels or other similar endless pull down means may be located downstream of the forming collar to pull the tubing downwardly. Alternatively, the tubing may be pulled downwardly by the cross-sealing mechanism 17 or, in certain circumstances, by positive grippers.

The web or film 11 is stored on a rotatably mounted supply roll 25 which is located upstream of the tube former 12. As the film is unwound from the supply roll, it passes beneath a guide roller 26, over the top of a spring-loaded dancer roller 27 and around several guide rollers 28, 29, 30, 31, 32, 33, 34, 35 and 36 before proceeding to the forming collar 13. All of the guide rollers except the rollers 32 and 36 are disposed in fixed locations. The guide rollers 32 and 36 may be selectively adjusted back and forth in a horizontal direction.

Force of significant magnitude is required to overcome the inertia of the supply roll 25 and to pull the film 11 from that roll. In some prior machines, the force created by the pull down means downstream of the forming collar 13 is used to pull the film from the supply roll. It has been recognized, however, that such an arrangement is disadvantageous and particularly if the film is a thin film having a thickness as low as, for example, 0.0015 inches. If such a film is pulled from the supply roll by a force downstream of the forming collar, the film can become severely stretched or stressed and may not be drawn into proper tracking relation with the collar. To avoid these disadvantages, some machines include a power assist pay off mechanism upstream of the forming collar to unwind the film from the supply 25 and to feed the web toward the collar. In such machines, it is necessary to correlate the operation of the upstream power assist mechanism with the operation of the downstream pull down means in order to insure that a precisely measured length of film will be drawn past the forming collar for each transverse sealing operation.

The present invention contemplates the provision of a new and improved power assist pay off mechanism 40 whose operation is uniquely correlated with the operation of the pull down belts 20 and 21 in such a manner as to reduce wear of the belts, to insure against the adverse accumulation of film 11 upstream of the forming collar 13 if the belts should malfunction, and to enable better control to be maintained over the tension in the film as the film is drawn downwardly over the collar. The pay off mechanism 40 of the present invention is particularly characterized by the fact that it is driven synchronously with the pull down belts 20 and 21 and yet is capable of slipping relative to the film to the extent necessary to properly match the rate at which the film is pulled off of the supply roll with the rate at which the film is pulled downwardly past the forming collar.

Figure 2:
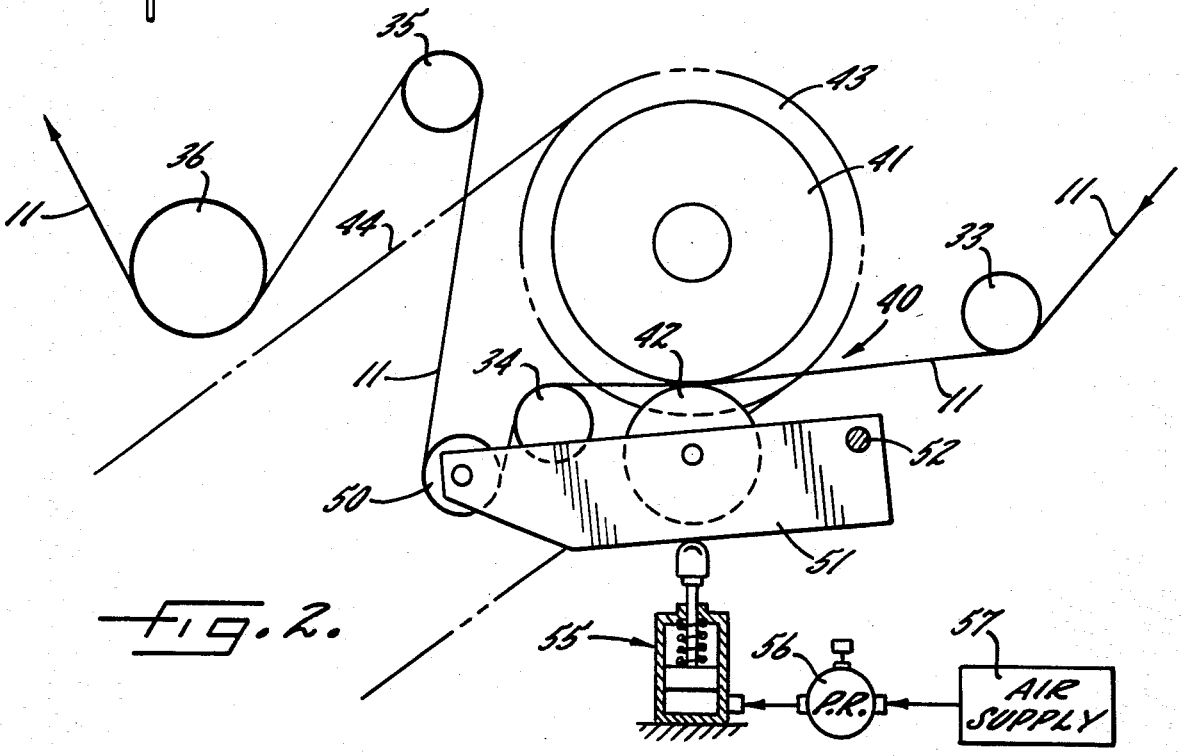
FIG. 2 is an enlarged schematic side elevational view of certain parts shown in FIG. 1.

More specifically, the pay off mechanism 40 of the invention includes a power-rotated feed roll 41 (FIG. 2) which is located between the guide rolls 33 and 34. The feed roll is located above a horizontal run of the film 11 and directly overlies a rotatable pinch roll 42 which also forms part of the pay off mechanism 40. When the feed roll is rotated, the film is gripped frictionally between the feed roll and the pinch roll and is pulled from the supply roll 25 and advanced toward the forming collar 13.

In carrying out the invention, the feed roll 41 is driven in synchronism with the pull-down belts 20 and 21 but is driven at a faster linear or surface speed than the belts so that, in a given time interval, the feed roll tends to pull a slightly greater length of film 11 from the supply roll 25 than the belts tend to pull past the forming collar 13. For this purpose, a drive sprocket 43 (FIG. 2) is associated with the feed roll and is slightly smaller in diameter than the drive sprockets 22 and 23. By way of example only, each of the drive sprockets 22 and 23 may have twenty-two equally spaced teeth while the drive sprocket 43 may have only twenty-one equally spaced teeth of the same pitch as the pitch of the teeth of the sprockets 22 and 23. When the sprockets are rotated by a common drive chain 44, the feed roll 41 is rotated at a linear or surface speed (i.e., speed in terms of in./min.) which is slightly greater than the surface speed of the belts 20 and 21. As shown in FIG. 1, the chain is trained around the sprockets 22, 23 and 43 and also is trained around a sprocket 45 on the output of an electric clutch-brake unit 46. The input of the clutch-brake unit is driven by an electric motor 47 which acts through a speed reducer 48. When the clutch of the unit is engaged, the brake is simultaneously disengaged to enable the motor to drive the belts 20 and 21 and the feed roll 41 by way of the chain 44. When the clutch is disengaged, the brake engages to stop the belts and the feed roller.

Further in carrying out the invention, means are provided for sensing the tension in the film 11 at a location between the forming collar 13 and the feed roll 41 and for causing the feed roll to slip relative to the film as an inverse function of that tension so as to properly correlate the supply of the feed roll with the demand of the belts 20 and 21. Herein, these means comprise a roller 50 (FIG. 2) which is located below and between the guide rollers 34 and 35 such that a loop of film passes downwardly beneath and then upwardly from the tension roller 50. The latter is rotatably supported on one end portion of a member or arm 51 (FIG. 2) whose opposite end portion is pivotally mounted at 52 so as to enable the roller 50 to swing upwardly and downwardly about a horizontal axis. The pinch roll 42 also is rotatably supported by and is swingable with the arm 51 and is disposed at a location between the tension roller 50 and the pivot 52. Resiliently yieldable means in the form of an air spring 55 engages the underside of the arm 51 directly below the pinch roll 42 and biases the arm upwardly against its own weight. The biasing force exerted by the air spring may be selectively adjusted by changing the setting of a constant pressure regulator 56 to vary the pressure of pressurized air supplied to the air spring from an air source 57. In lieu of the air spring, a mechanical spring may be used to urge the arm 51 upwardly, suitable means being provided to enable the force exerted by the spring to be selectively adjusted.

With the foregoing arrangement, a decrease in the tension in the loop of film 11 between the guide rollers 34 and 35 allows the tension roller 50, the arm 51 and the pinch roll 42 to swing downwardly about the pivot 52. As a result, the pressure between the pinch roll 42 and the feed roll 41 is reduced so as to increase the slippage of the feed roll relative to the film and to cause the feed roll to pull less film from the supply roll during a given time interval T. Conversely, the tension roller 50, the arm 51 and the pinch roll 42 are pulled upwardly by the loop of film between the guide rollers 34 and 35 when the tension in that loop increases. Accordingly, the pressure between the pinch roll and the feed roll is increased to cause the feed roll to slip to a lesser degree relative to the film and thereby pull a greater length of film from the supply during the time interval T.

OPERATION AND ADVANTAGES

To explain the operation of the overall film feeding system, let it be assumed that the clutch of the clutch-brake unit 46 is engaged and that the brake of that unit is disengaged for a time interval T-1 during which film 11 is advanced. Let it further be assumed that, with an intermittently operable machine 10 of the type described, the clutch is disengaged and the brake is engaged for a predetermined time interval T-2 during which the film is stationary while the sealing, filling and cutting operations are being performed. Engagement and disengagement of the clutch and the brake to establish the time intervals T-1 and T-2 may be effected by conventional control means whose operation need not be described here. It will suffice to say that, when a film with a repeating printed pattern is being run, the control means may include a photoelectric scanner 60 (FIG. 1) which detects printed targets on the film and which produces a control signal each time a target passes the scanner. The control signal from the scanner is used to cause the film to be advanced through a time interval T-1 which is effective to maintain registration between the printed pattern on the film and the cross-seals which are ultimately formed on the tubing 14. In this particular instance, the scanner is located between the guide rollers 29 and 30 but the scanner could be positioned at various other locations upstream of the pay off mechanism 40.

In keeping with the invention, the clutch of the clutchbrake unit 46 is engaged for a time interval T-1 which is effective to cause the pull-down belts 20 and 21 to pull one package length of film 11 downwardly past the forming collar 13. The belts operate with virtually zero slippage relative to the tubing 14 and thus the belts perform the measuring function of the film feed system. That is, when the belts are driven for a time interval T-1, the length of film which is pulled past the forming collar is determined by the duration of the time interval and by the surface speed of the belts.

At the same time the belts 20 and 21 are started to pull the film 11 past the collar 13, the feed roll 41 is rotated to pull film off of the supply roll 25. Because the surface speed of the feed roll is greater than the surface speed of the belts, the feed roll would, under a condition of zero slippage relative to the film, supply more film to the collar during the time interval T-1 than could be accommodated by the action of the belts during that time interval. Under such conditions, an excess amount of film would accumulate between the feed roll and the forming collar. This is avoided, however, by causing the feed roll to slip relative to the film as an inverse function of the film tension at a location between the feed and the collar. As that tension decreases and signals a potential oversupply of film, the tension roller 50 and the pinch roll 42 swing downwardly to reduce the pressure between the pinch roll and the feed roll, to increase the slippage of the feed roll relative to the film and to reduce the amount of film actually supplied by the feed roll to the same amount actually demanded by the belts 20 and 21. On the other hand, the tension in the film between the feed roll 41 and the collar 13 increases if the amount of film supplied by the feed roll tends to be insufficient to satisfy the demand of the belts. Under these circumstances, the tension roller 50 and the pinch roll 42 are swung upwardly by the film to increase the pressure of the pinch roll against the pressure roll, to reduce the slippage of the feed roll relative to the film and to cause the feed roll to increase the supply of film to the collar and the belts.

In summary, the feed roll 41 is driven for the same time interval as the belts 20 and 21 and at a higher surface speed than the belts to insure that, under all conditions, the feed roll will be capable of supplying sufficient film to meet the demand of the belts. When the feed roll tends to create an oversupply, the feed roll is caused to slip relative to the film in order to match the supply of the feed roll with the demand of the belts.

The foregoing provides several advantages over prior packaging machines with power assist pay off mechanisms. First, the drive belts 20 and 21 and the feed roll 41 are driven in precise synchronism with one another and for the same time interval. Accordingly, for practical purposes, the drive belts and the feed roll form an integrated feed system, do not cycle separately of each other and do not require controls or components to effect separate cycling.

If one or both of the belts 20 or 21 should break or fail to pull the film 11 downwardly, the lost tension at the tension roller 50 causes all of the pressure between the pinch roll 42 and the feed roll 41 to be relieved almost immediately so as to automatically stop any further feeding of film toward the collar 13. As a result, film does not continue to feed out and accumulate upstream of the collar in the event of a downstream malfunction and thus the machine 10 may be placed back in operation more quickly after the malfunction has been corrected. Moreover, the belts are susceptible to less wear than is the case in machines where the belts must necessarily slip relative to the tubing in order to maintain correlation between the belts and the power assist pay off mechanism.

The present machine 10 also enables better control to be maintained on the tension of the film 11 at the forming collar 13. As a result of the tension roller 50 and the arm 51, positive tension is imparted to the film at a location between the collar 13 and the feed roll 41. By adjusting the air spring 55, such tension can be increased or decreased as necessary for different types of films or for different feed rates so as to establish optimum tension in the film as the latter approaches the feed collar.

What is claimed is:

1. A machine for forming, filling and sealing packages, said machine being of the type in which a web of flexible material is pulled from a supply and past means for forming the web into tubing, in which product to be packaged is delivered into the tubing, and in which sealing operations are performed on the tubing to form packages, said machine comprising pay off means located between said supply and said forming means for pulling said web from said supply, pull down means located downstream of said forming means and acting on said tubing to pull said web past said forming means, means for driving said pull down means at a linear speed which is effective to pull a predetermined length of web past said forming means in a predetermined time interval, means for driving said pay off means for the same time interval as said pull down means and at a linear speed which is greater than the linear speed of said pull down means, and means for sensing the tension of said web at a location between said pay off means and said forming means and for causing said pay off means to slip relative to said web as an inverse function of said tension.

2. A machine as defined in claim 1 in which said driving means drive said pull down means and said pay off means intermittently.

3. A machine as defined in claim 1 in which said pay off means comprise a power-driven feed roll disposed on one side of the web and further comprise a pinch roll disposed on the opposite side of the web and operable to press the web against the feed roll, said tension sensing means being operable to move one of said rolls toward and away from the other of said rolls when said tension increases and decreases, respectively.

4. A machine for forming, filling and sealing packages, said machine being of the type in which a web of flexible material is pulled from a supply and past means for forming the web into tubing, in which product to be packaged is delivered into the tubing, and in which sealing operations are performed on the tubing to form packages, said machine comprising a feed roll located between said supply and said forming means and frictionally engageable with said web to pull the web from the supply, endless pull down means located downstream of said forming means and frictionally engageable with said tubing to pull said web past said forming means, means for intermittently driving said pull down means for a predetermined time interval and at a surface speed which is effective to cause said pull down means to pull a predetermined length of web past said forming means during said time interval, means for intermittently rotating said feed roll for the same time interval but at a surface speed greater than the surface speed of said pull down means whereby to cause said feed roll to pull from said supply a length of web greater than said predetermined length under a condition of zero slippage of said web relative to said feed roll, and means responsive to the tension of said web at a location between said feed roll and said forming means and operable to cause said feed roll to slip relative to said web as an inverse function of said tension.

5. A machine as defined in claim 4 in which said feed roll frictionally engages one side of said web, a pinch roll frictionally engageable with the opposite side of said web and operable to press the web against the feed roll, means mounting said pinch roll for movement toward and away from said feed roll, said tension responsive means being operable to move said pinch roll toward and away from said feed roll when said tension increases and decreases, respectively.

6. A machine as defined in either of claims 4 or 5 in which said tension responsive means apply tension to the web at a location disposed between said feed roll and said forming means, and means for selectively adjusting the degree of tension applied to the web by said tension responsive means.

7. A machine for forming, filling and sealing packages, said machine being of the type in which a web of flexible material is pulled from a supply and past means for forming the web into tubing, in which product to be packaged is delivered into the tubing, and in which sealing operations are performed on the tubing to form packages, said machine comprising pay off means located between said supply and said forming means for pulling web from said supply, said pay off means comprising a rotatable feed roll disposed on one side of the web and further comprising a rotatable pinch roll disposed on the other side of the web and operable to press the web against the feed roll so as to cause the web to be pulled off of said supply when the feed roll is rotated, a pair of endless belts located downstream of said forming means and engageable with opposite sides of said tubing, means for intermittently driving said belts for a predetermined time interval and at a surface speed which is effective to cause said belts to pull a predetermined length of web past said forming means during said time interval, said driving means also intermittently rotating said feed roll for the same time interval but at a surface speed greater than the surface speed of said belts whereby to cause said feed roll to coact with said pinch roll to pull from said supply a length of web greater than said predetermined length under a condition of zero slippage of said web relative to said feed roll and said pinch roll, means mounting said pinch roll for movement (a) toward the feed roll to increase the pressure of the pinch roll against the feed roll and reduce slippage of the web relative to the rolls and (b) away from the feed roll to decrease the pressure of the pinch roll against the feed roll and increase slippage of the web relative to the rolls, and means responsive to the tension of the web at a location between said pay off means and said forming means for moving said pinch roll toward said feed roll when said tension increases and for moving said pinch roll away from said feed roll when said tension decreases.

8. A machine as defined in claim 7 in which said tension responsive means apply tension to the web at a location disposed between said pay off means and said forming means, and means for selectively adjusting the degree of tension applied to the web by said tension responsive means.

9. A machine as defined in claim 7 in which said mounting means comprise a member rotatably supporting said pinch roll and mounted to pivot about an axis extending parallel to the axis of said pinch roll, said tension responsive means comprising a roller supported by said member and located between said pinch roll and said forming means, said web looping around said roller and acting on the latter to cause said member and said pinch roll to swing toward and away from said feed roll when said tension increases and decreases, respectively.

10. A machine as defined in claim 9 in which said pinch roll is located on said member between said roller and the pivot axis of said member.

11. A machine as defined in claim 9 in which said member is mounted to pivot upwardly and downwardly, and yieldable means located beneath said member and biasing said member upwardly.

12. A machine as defined in claim 11 further including means for adjusting the biasing force exerted by said yieldable means.

13. A machine as defined in claim 7 in which said driving means include a first drive sprocket associated with said feed roll and a second drive sprocket associated with one of said belts, the diameter of said first drive sprocket being smaller than the diameter of said second drive sprocket, a chain trained around said sprockets, and mechanism for intermittently driving said chain.

14. A machine as defined in claim 13 further including a third drive sprocket associated with the other one of said belts and having the same diameter as said second drive sprocket, said chain also being trained around said third drive sprocket.

15. A method for forming, filling and sealing packages in which a web of flexible material is pulled from a supply and past means for forming the web into tubing, in which product to be packaged is delivered into the tubing and in which sealing operations are performed on the tubing to form packages, said method comprising the steps of, pulling on the tubing at a location downstream of said forming means with a force which is effective to pull a predetermined length of web past said forming means in a predetermined time interval, pulling on the web at a location between said supply and said forming means with a separate force which, under a non-slip condition relative to the web, is effective to pull from said supply during the same time interval a length of web greater than said predetermined length, and modifying said separate force to different slip conditions relative to said web in response to and as an inverse function of changes in the tension of the web at a location between said forming means and the point of application of said separate force.

* * * * *